United States Patent [19]

Eickelmann

[11] Patent Number: 4,472,063

[45] Date of Patent: Sep. 18, 1984

[54] MIXER IMPLEMENT FOR LIQUIDS

[75] Inventor: Rolf W. Eickelmann, Tacoma, Wash.

[73] Assignee: INRI–International New Roofing Industries, Inc., Tacoma, Wash.

[21] Appl. No.: 510,730

[22] Filed: Jul. 5, 1983

[51] Int. Cl.[3] ..... B01F 7/00; B01F 7/24; B01F 7/32

[52] U.S. Cl. ..... 366/129; 366/310; 366/320; 366/343; 366/605

[58] Field of Search ..... 366/129, 110, 130, 117, 366/287, 288, 292, 310, 318, 320, 325, 329, 339, 349, 605, 343, 344

[56] References Cited

U.S. PATENT DOCUMENTS 927,952 7/1909 Cooke .
954,511 4/1910 Gordon ..... 366/320
1,061,987 5/1913 Craig ..... 366/320
2,390,186 12/1945 Sharp ..... 259/44
3,681,308 8/1972 Irvin et al. ..... 260/80.78
3,944,534 3/1976 Sennari et al. ..... 260/93.7
4,054,272 10/1977 Cooke ..... 366/343

*Primary Examiner*—Timothy F. Simone
*Attorney, Agent, or Firm*—Christensen, O'Connor, Johnson & Kindness

[57] ABSTRACT

A mixer implement for liquids in which longitudinally spaced guard rings are supported by a rotary shaft through radial struts formed as impeller blades and which also support complemental helically formed impeller blades extending between them. Liquid motion patterns are set up by shaft rotation which effects rapid thorough mixing action which can be accelerated by an attendant stirring motion if desired.

4 Claims, 4 Drawing Figures

Fig. 3.
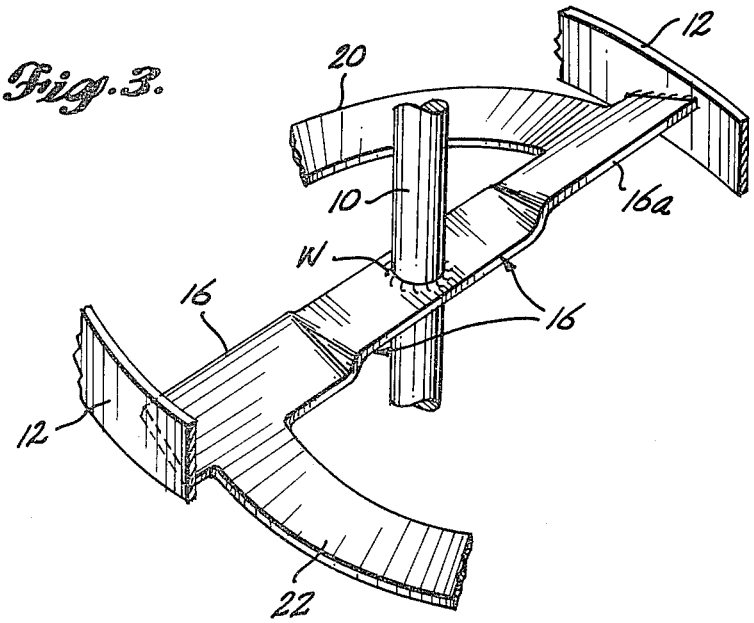
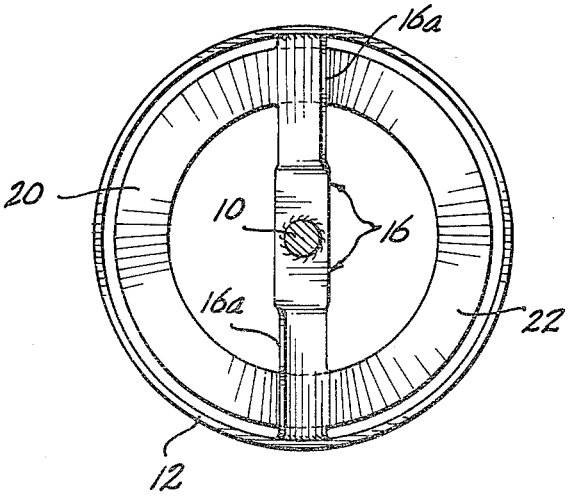
Fig. 4.

MIXER IMPLEMENT FOR LIQUIDS

BACKGROUND OF THE INVENTION

This invention relates to an improved implement for mixing paints, bonding compositions, asphalt emulsions, and other liquids in containers, and is herein illustratively described in its presently preferred form; however, it will be recognized that certain modifications and changes with respect to details may be made without departing from the essentials of the inventive concept.

The mixing of liquid materials such as those referred to above is often tedious and time-consuming. Moreover, thorough mixing, including the reaching of heavier and semi-solidified components settled in the bottom corners of the container is not consistently achieved. To the worker in the field, it is desirable to have an implement on hand that can be gripped and operated in the chuck of an electric drill, for example, where the drill motor operates through a speed reduction/torque multiplication system so as to provide the necessary torque and sustained power to do the job without overheating the motor. Furthermore, inasmuch as containers of the various substances involved, even in a given size range, come in different diameter/length ratios, and the various substances encountered have many different characteristics, it is important to have a mixing implement that will work in and with each of a variety of containers and substances, one that consumes minimum power and requires minimum drive torque for the task performed, and one that functions effectively to achieve thorough mixing in a relatively short time period. It is also desirable that the implement itself be sturdy and relatively invulnerable to accidental damage, hence reusable without limitation, and yet be sufficiently light in weight to be handled and used easily.

The invention is directed to the fulfillment of these and related objectives. Also, the invention provides a mixing implement usable in the manner indicated and that can be moved about orbitally by hand as it is motor driven in the container so as to shift the locus of flow inducing forces within the container in order to expedite the process, and in so doing to perform a kind of collateral stirring function, particularly when working in a container much larger than the outer peripheral diameter of the rotary implement itself. Yet the implement is quite usable and held stationary as it rotates in a container only slightly larger in diameter than the rotary implement. Contemplating the first-mentioned situation, that wherein the collateral orbital hand-executed stirring motion is employed, the implement is designed to avoid projecting elements such as blade tips that might catch on or dig into the interior of the container and possibly stop the rotation or overload the drive motor or, in an extreme situation, puncture the container.

A further object hereof is to devise an efficient stirring implement for such purposes imparting multiple toroidal paths circulatory motion to the contents of a container of such a nature effective to cause intermingling and thereby rapid mixing of all liquid components with minimum stratification flow paths that actually defy mixing.

These and related objects will appear as the description proceeds.

SUMMARY OF THE INVENTION

In accordance with this invention, a rotary mixer implement is provided, including an upright shaft that is adapted to be chucked in a rotary drill motor or the like and to extend downwardly generally centrally into a liquid container. Upper and lower guide rings coaxial with the shaft and spaced apart lengthwise of the shaft are supported from the shaft by elongated radially extending upper and lower sets of struts, preferably formed as flat strips with a pitch angle to serve as impeller blades. Two or more helically extending impeller blades interconnecting the struts near their outer ends where they join the rings continue the pitch of the strut blades and themselves serve as impellers. The rings serve to protect impeller elements against bending, to prevent impeller elements impacting the container sides during operation and, together with the struts and the helical impellers of like pitch, serve a role in forming toroidal flow paths with intermediate circulation paths assuring efficient mixing of the liquids.

These and other features, aspects, and advantages of the invention will become more fully evident as the description continues.

BRIEF DESCRIPTION OF THE DRAWINGS

FIG. 3 is a top perspective view of an upper fragmentary portion of the implement showing segments of the upper guard ring, the drive shaft, a set of impeller-formed struts positioning the ring and adjoined to the upper ends of associated helical impeller blades which are broken away for purposes of illustration.

FIG. 4 is a transverse sectional view taken on line 4—4 in FIG. 1.

DETAILED DESCRIPTION REFERRING TO DRAWINGS

Figure 2:
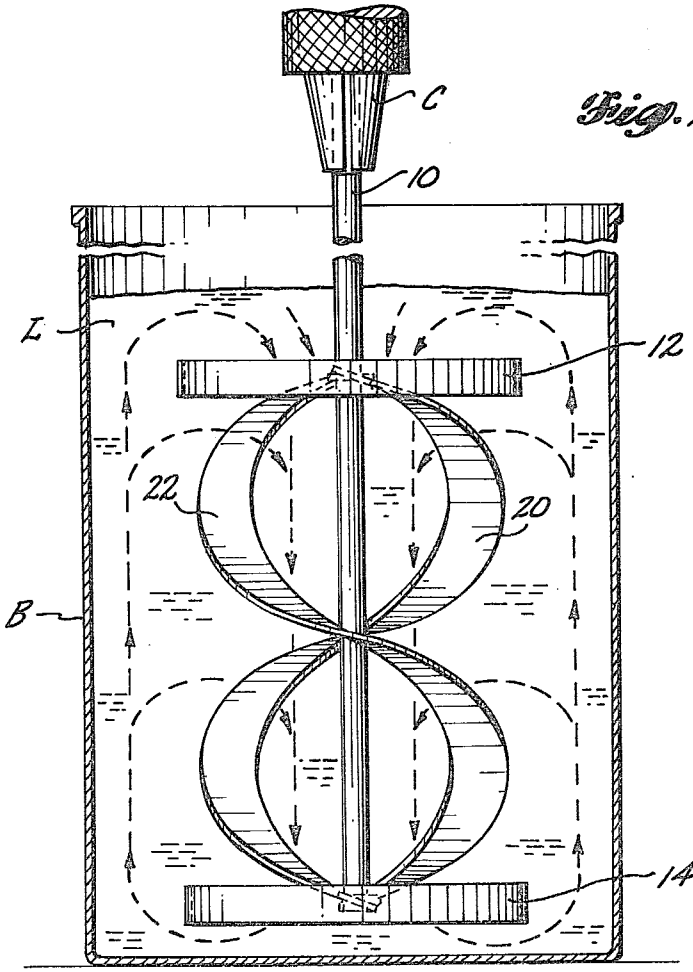
FIG. 2 is a side view with the implement mounted in the chuck, inserted in a liquid container and operating to impel the liquid into motion to perform the mixing function.
Figure 1:
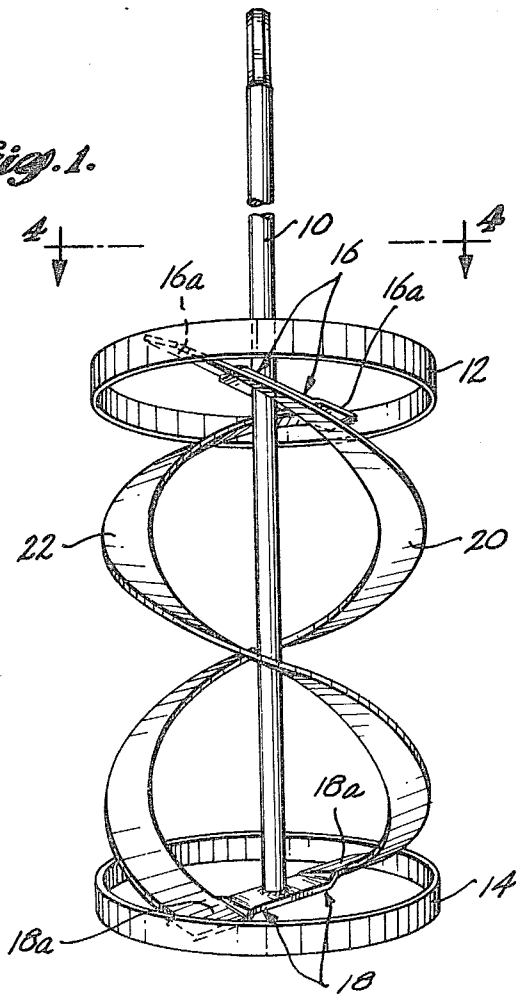
FIG. 1 is a side perspective view of the mixer implement in its preferred form adapted to be driven by a portable electric drill motor or possibly a drill press motor with a chuck.

The illustrated mixing implement comprises a rotationally driven support shaft 10 adapted at its upper end 10*a* to be received in and gripped by the jaws of a rotary power source chuck C and to extend downwardly generally centrally into a liquid container, such as the container B in FIG. 2 holding a liquid or combination of liquids L to be mixed. Upper and lower short cylindrical guard rings 12 and 14 coaxial with the shaft and spaced apart lengthwise of the shaft are supported from the shaft by elongated radially extending upper and lower sets of struts 16 and 18 preferably formed as flat elongated metal strips whose radially outer portions 16*a* and 18*a*, respectively, are angled to the rotary planes of the respective struts at an acute pitch angle to serve as cooperating impeller blades. These angled portions continue radially outward into abutment with the respective guard rings 12 and 14 which they support and to which they are welded or otherwise joined.

In addition, the mixer implement includes (two or more) elongated flat strips 20 and 22 formed helically as additional impeller blades extending around the axis of shaft 10 just within the protective cylindrical boundary defined by the guard rings 12 and 14 and each interconnecting one of the upper struts with one of the lower struts as shown. Preferably the helix angle, that is the impeller pitch angle of the helical blades 22 and 22, approximates the pitch angle of the radial strut impeller blades such that one continues smoothly from the other and as a group the helical blades and struts serve cooperatively to impel liquid in the same direction within the container, generally parallel to the shaft 10, that is either upwardly or downwardly depending upon the direction of implement rotation.

The system of interconnected parts is a system of mutual structural reinforcement and protection (in handling and in use) of the individual parts by the assembled whole. As a matter of manufacturing convenience, it is preferred to form the helical blades 20 and 22 and then to weld them at their ends to the edges of the associated radial struts which those ends abut, or if preferred, to secure them directly instead of thus indirectly to the rings 12 and 14.

In FIG. 2 flow patterns of liquid L created by rotation of the immersed impeller are suggested by dotted lines with arrows. However, while those flow lines are intended to depict the multiple toroidal paths created by impeller rotation, the view falls short of fully charting the multiplicity of paths and the complexity of those paths achieved to the end of rapid and thorough mixing. Also not depicted in the view is the practical supplementary motion that the user, for instance a person holding a geared-down hand drill motor turning the impeller, can exercise by applying a stirring or orbital motion to the immersed implement as well as an up-and-down or a complex of motions superimposed on driven rotation of the shaft so as to further expedite and complete the thoroughness with which the mixing is achieved. During such manually imposed action, the rotating impeller may be moved from side to side and around the periphery as well as up and down and into the lower corners of the container so as to reach and activate into motion all components of the liquid. This may be done without fear of damage to the container itself or to the impeller and without impeller blades or struts being caught by and digging into and possibly perforating the container, since the guard rings 12 and 14 function to prevent this whether or not the axis of the shaft 10 is maintained perfectly vertical or whether it is tilted sideways from time to time during the process. Yet the rings themselves add but little to the resistance to rotation and they also help direct the flow into desired circuits. Preferably the rings 12 and 14 are thin radially and relatively wide longitudinally of the implement.

Preferably also, the upper and lower sets of struts include two struts each and are formed from a single elongated strip apertured midway between its ends to pass the shaft 10 and to be secured to the shaft by welding W. If desired, of course, three (or more) angularly spaced struts may make up a single set and if desired, an equal number of helically formed impeller blades joined to them. In order to derive maximum impulsion effect from the impellers, the outer helix circle or cylinder defined by the helically extending blades is only slightly smaller in diameter than the inside diameter of the guard rings. One or more additional sets of struts and guard rings may be added if desired.

These and other variations and modifications of the preferred and illustrated form of the invention are intended to be included within the claims that follow as equivalent to the illustrated embodiment.

The embodiments of the invention in which an exclusive property or privilege is claimed are defined as follows:

1. A rotary mixer implement operable with paint or other liquids in an upright container, comprising an elongated rotary shaft adapted to be immersed extending downwardly generally centrally into the container, upper and lower guide rings coaxial with the shaft and spaced apart lengthwise thereof for immersion with the shaft, respective upper and lower sets of elongated radially extending support struts fixedly interconnecting the shaft and said upper and lower rings to support said rings in relation to the shaft, each support strut comprising an elongated strip of which at least the radially outer portion is pitched to form an impeller blade, and a plurality of elongated helical impeller blades extending lengthwise of the shaft between the rings, each of said helical impeller blades having a blade pitch substantially equal to the blade pitches of the other helical impeller blades, the radially outer portions of said support struts and said helical impeller blades being operable by shaft rotation to impel the liquid generally in a single direction parallel to the shaft.

2. The mixer implement defined in claim 1 wherein the rings are larger in outer diameter than the outer diametral extent of the helical blades.

3. The mixer implement defined in any of claims 1 or 2 wherein the rings are substantially of the same diameter and are coaligned, each such ring being thin radially in relation to its width parallel to the shaft.

4. The mixer implement defined in claim 1 wherein the upper set of struts and the lower set of struts comprise individual elongated diametrically extending flat strips the midportions of which are perpendicular to and joined to the shaft and wherein the helical impeller blades have respective upper and lower ends joined to the angled outer portions of the respective struts immediately inside the upper and lower rings and which are formed to continue the pitch of the radial strut blades over substantially the full length of said helical blades.

* * * * *